US010239190B2

(12) United States Patent
Tsui et al.

(10) Patent No.: US 10,239,190 B2
(45) Date of Patent: Mar. 26, 2019

(54) RELEASE MECHANISM FOR CLAMPING TOOLS

(71) Applicants: Gary Tsui, San Marino, CA (US); Weinan Liu, Monrovia, CA (US); Shaosheng Chen, Los Angeles, CA (US)

(72) Inventors: Gary Tsui, San Marino, CA (US); Weinan Liu, Monrovia, CA (US); Shaosheng Chen, Los Angeles, CA (US)

( * ) Notice: Subject to any disclaimer, the term of this patent is extended or adjusted under 35 U.S.C. 154(b) by 0 days.

(21) Appl. No.: 15/893,433

(22) Filed: Feb. 9, 2018

(65) Prior Publication Data

US 2018/0161962 A1 Jun. 14, 2018

Related U.S. Application Data

(63) Continuation-in-part of application No. 15/093,580, filed on Apr. 7, 2016.

(51) Int. Cl.

| | |
|---|---|
| ***B25B 5/10*** | (2006.01) |
| ***B25B 5/02*** | (2006.01) |
| ***B25B 5/14*** | (2006.01) |
| ***B25B 5/16*** | (2006.01) |
| ***B25B 1/12*** | (2006.01) |
| ***B25B 5/06*** | (2006.01) |
| *B25B 1/02* | (2006.01) |
| *B25B 1/08* | (2006.01) |
| *B25B 1/00* | (2006.01) |
| *B25B 3/00* | (2006.01) |

(52) U.S. Cl.

CPC ..... *B25B 5/10* (2013.01); *B25B 1/12* (2013.01); *B25B 5/02* (2013.01); *B25B 5/064* (2013.01); *B25B 5/142* (2013.01); *B25B 5/166* (2013.01); *B25B 1/00* (2013.01); *B25B 1/02* (2013.01); *B25B 1/08* (2013.01); *B25B 3/00* (2013.01)

(58) Field of Classification Search

CPC .... B25B 5/10; B25B 1/12; B25B 5/02; B25B 5/064; B25B 5/142; B25B 5/166; B25B 1/08; B25B 3/00; B25B 1/00; B25B 1/02

USPC ..... 269/207

See application file for complete search history.

(56) References Cited

U.S. PATENT DOCUMENTS 2,137,642 A * 11/1938 Cavanagh ..... B25C 5/0285 227/132

5,887,493 A * 3/1999 Main ..... B25B 13/463 81/57.29

(Continued)

*Primary Examiner* — Monica S Carter
*Assistant Examiner* — Katina N. Henson
(74) *Attorney, Agent, or Firm* — Jen-Feng Lee, Esq.

(57) ABSTRACT

The present invention provides an improved release mechanism for clamping tools where problems of thread slipping due to worn out thread can be reduced by the structure of a plunger with a small diameter section and the engagement of the thread shaft is made more secure by the cam action on account of the shape of the plunger. A protrusion extends from a push button on a top portion of the half-threaded nut. Threads are formed on an upper portion of the hole for engaging the threaded shaft. The middle portion of the plunger is made to have a section of small diameter allowing the protrusion to be pushed downward in a normal position and allowing the protrusion to rely on the resilient power of the helical spring to push it upward into the small diameter section.

7 Claims, 7 Drawing Sheets

(56) References Cited

U.S. PATENT DOCUMENTS

| | | | | |
|---|---|---|---|---|
| 6,860,475 | B2 * | 3/2005 | Wong | B25B 5/003 269/41 |
| 2013/0180053 | A1 * | 7/2013 | Rubin | B25F 1/04 7/118 |
| 2015/0306742 | A1 * | 10/2015 | Amrecki | B25B 5/064 269/34 |

* cited by examiner

RELEASE MECHANISM FOR CLAMPING TOOLS

PRIORITY CLAIM

This application is a continuation in part, under 37 CFR 1.53(b), of a co-pending U.S. patent application Ser. No. 15/093,580 also entitled Improved Release Mechanism For Clamping Tools by the same inventors, Gary TSUI, Weinan LIU (erroneously spelled as Weinam LIU), and Shaosheng CHEN, the disclosure of which is incorporated herein by reference. Present CIP application claims priority of the filing date of Apr. 7, 2016, per the requirements of 35 U.S.C. § 120 and 37 C.F.R. 1.78.

FIELD OF THE INVENTION

The present invention relates to an improved mechanism for release of the clamp force when a work piece is being held in place by clamping tools or vises.

DISCUSSION OF RELATED ART

Commercially available clamping tools oftentimes come with a "quick release" button where, instead of turning a gear/knob pitch-by-pitch to loosen the grip, a push on the button releases the engagement of the clamp parts to the work piece.

The construction of such a release button invariably incorporated the element of a spring to provide the resilient force for keeping the engagement in place.

As shown and discussed herein, the current art "quick release" mechanism may lead to thread slipping/jumping problem through repeated use of the device. Also, since the power to keep the work piece engagement is from the resilient force of the spring, the contact may not be too solid, once the spring starts to lose its resilience force, similarly through repeated use of the device.

Consequently, there exists a need to provide an improved mechanism where the thread slipping due to worn-out thread pattern is reduced or eliminated, and the contact power to keep the work piece engaged is made to be more solid by the cam action as more fully disclosed herein.

The implementation of the improved mechanism for the release of the grip also enhances the worker safety, due to reduced accidental work piece becoming loose, on account of the reduction of problem associated with the thread slipping or jumping.

SUMMARY OF THE INVENTION

Present invention disclosed an improved release mechanism to release the clamp force applied by a vise or clamp, when a work piece is to be removed from the vise/clamp. The improved release mechanism also reduces the problem of thread slipping/jumping caused by repeated use when the thread lines are worn down or worn out.

A typical vise or clamp generally provides a mechanism to tighten the grasp of a work piece in the form of a shaft where a handle on the shaft can be turned to tighten or loosen the grasp.

When loosening the grasp to allow a work piece to be removed, a quick release button is also provided as part of the mechanism, to save time needed from the untightening, or loosening of the clasp by reverse-turning of the handle.

An example of this current art quick release button is shown in the U.S. Pat. No. 6,860,475 patent ("475 Patent").

However, the current art quick release button suffers from the disadvantage of thread slipping (or jumping) when the thread lines are worn out after repeated uses.

The mechanism as disclosed in present application provides a more solid force to keep the tightening force in place and reduces the problems associated with the thread slipping issues. Consequently, the grip on the work piece is tighter and there is less safety concern to people working around the clamping tool.

BRIEF DESCRIPTION OF THE DRAWINGS

The accompanying drawings, which are incorporated in and constitute a part of this specification, illustrate the preferred embodiments of the invention and together with the description, serve to explain the principles of the invention.

A brief description of the drawings is as follows.

The following call out list elements can be a useful guide in referencing the element numbers of the drawings.

2 Bottom-Plate
5 Right-Angle Head
6 Threaded Shaft
7 Handle
10 Ear
11 Quick Release Mechanism
12 Quick Acting Push Button
13 Half-Threaded Nut
14 Helical Spring
15 Cylindrical Sleeve
16 Cover Plate
17 Two Screws
18 Holes
19 Two Holes
20 Cam
21 Neck
22 Vertical Spring
23 Vertical Spring Retainer
24 Half Threaded Nut Retainer
50 Housing
51 Cylindrical Plunger
52 Protrusion
53 Horizontal Helical Spring
54 Plunger Opening

55 Horizontal Plunger Guide
56 Plunger Retaining Frame

DETAILED DESCRIPTION OF THE PREFERRED EMBODIMENT

An example of current art quick release push button can be seen in the 475 Patent. The 475 Patent disclosed a clamping device which can be used to hold workpieces in a three dimensional 90-degree relationship with the addition of the Z-axis attachment. The workpieces can easily be removed after work by pressing the quick acting push button to release the threaded shafts mounted with the clamping heads. The quick acting push button is a quick release button. The swing away clamping arm of the Z-axis attachment gives additional room for easier removal of the workpieces if necessary.

Such a clamp contains three mutually perpendicular base plates namely, one square shape bottom-plate and two smaller rectangular side-plates. The bottom-plate includes two slotted holes along two adjacent edges which are not connected to the side-plates, one along each edge, so that the angle clamp can be fixed to a work desk with two screws. The bottom-plate is equipped with a protruded ear at the vertex away from the side-plates. The ear is positioned to face the opposite vertex.

The quick release mechanism on a clamp, such as that of the 475 Patent, has a quick acting push button and a half-threaded nut, mounted in the notch of the ear so that it is free to rotate about its vertical axis. A threaded shaft is inserted through the half-threaded nut in the direction of the diagonal of the bottom-plate. A more detailed disclosure can be seen in the specification of the 475 Patent, the disclosure of which is incorporated herein by reference.

Figure 1:
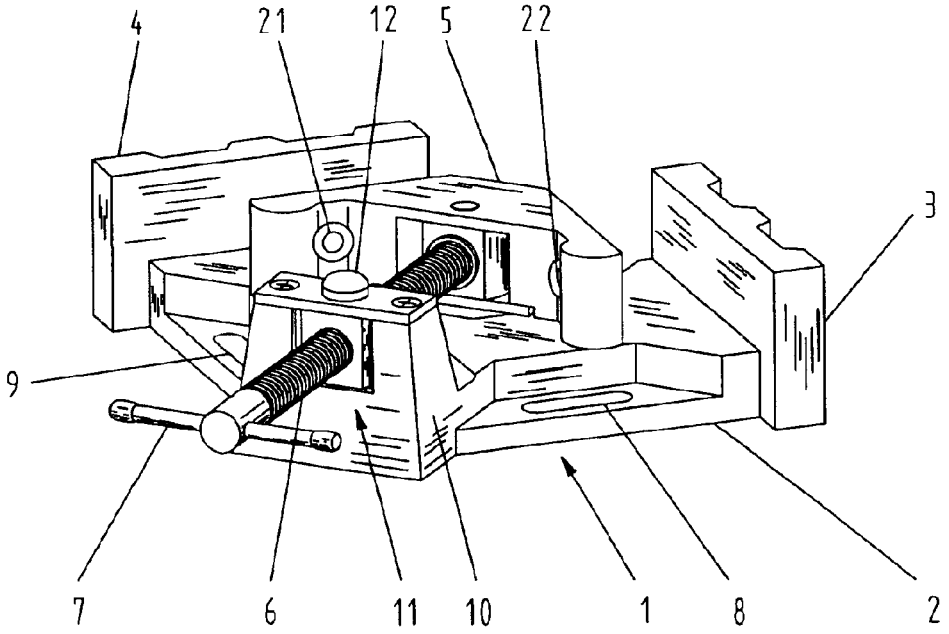
FIG. 1 (Prior Art)
FIG. 1 is the perspective view of a current art clamping tool with the release mechanism in the front.
Figure 2:
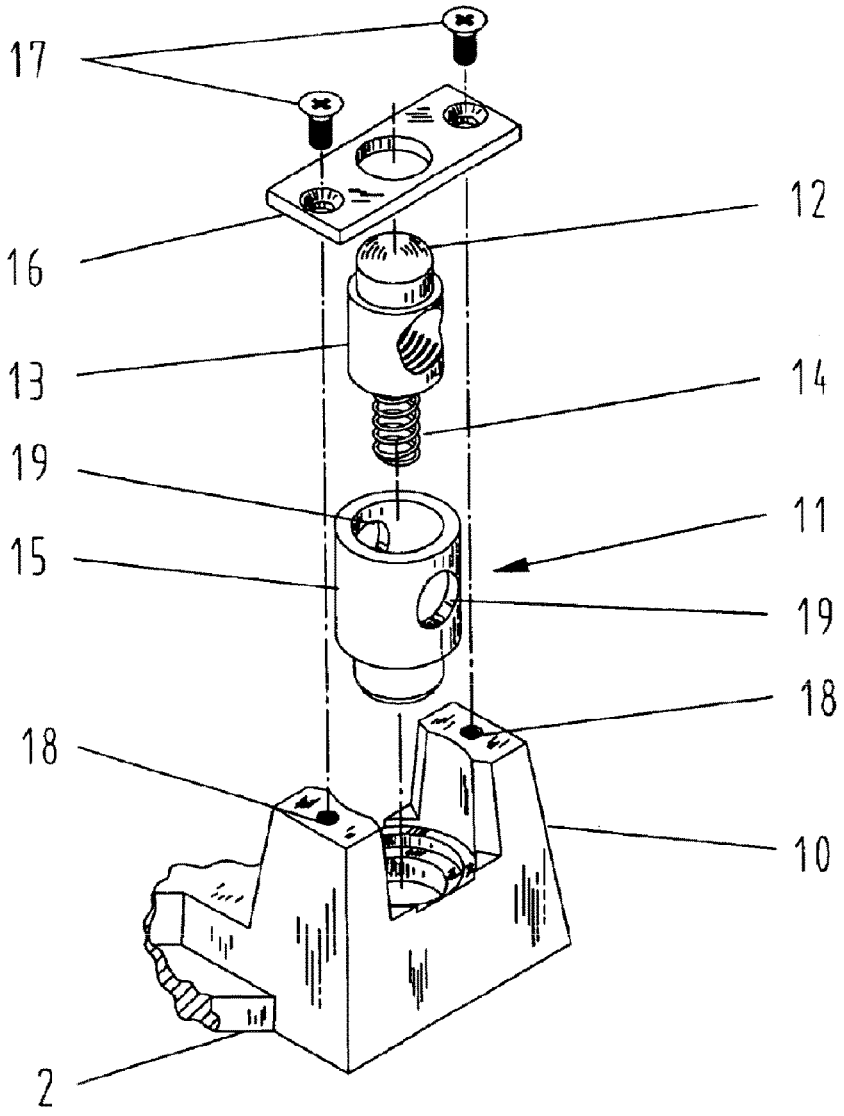
FIG. 2 (Prior Art)
FIG. 2 shows the exploded view of the quick release button/mechanism, where the thread pattern is made on the lower half of the nut.

Referring to FIG. 1 and FIG. 2, a current art quick release mechanism 11 with quick acting push button 12 is built into ear 10. Instead of moving slowly pitch by pitch by turning the threaded shaft 6, the right-angle head 5 can be moved forward or backward quickly with handle 7 by pressing the quick acting push button 12 to release the engagement of the threaded shaft 6 with the half-threaded nut 13.

FIG. 2 shows an exemplary implementation of the current art quick release mechanism 11. It comprises a quick acting push button 12 with half-threaded nut 13, helical spring 14, sleeve 15, cover plate 16 and two screws 17. Quick acting push button 12 is on the top portion of the half-threaded nut 13 which is threaded on the lower surface of the hole for feeding the threaded shaft 6. The half-threaded nut 13 is inserted into the center of a cylindrical sleeve 15 with helical spring 14 in between. Two holes 19 just big enough to feed threaded shaft 6 freely are equipped on both sides of the cylindrical sleeve 15. Sleeve 15 is inserted onto a recess area at the bottom of ear 10 so that it is free to rotate about its vertical axis. Quick acting push button 12, half-threaded nut 13, helical spring 14 and sleeve 15 are retained in position by cover plate 16 and two screws 17 which are screwed into holes 18 on the top surface of ear 10.

Threaded shaft 6 is fed through holes 19 and half-threaded nut 13. In normal position, threaded shaft 6 is engaged with the thread inside the hole of half-threaded nut 13. When the quick acting push button 12 is pressed, the thread of half-threaded nut 13 is disengaged from threaded shaft 6 so that shaft 6 is free to slide inside nut 13, hence the floating right-angle head 5 is free to slide over the surface of the bottom-plate 2 for quick and easy clamping and releasing of the workpieces.

Such current art release mechanism has some drawbacks based upon industry experience.

Experience shows that the thread pattern inside nut 13 gets worn out over repeated uses. This sometimes leads to thread slipping (or jumping) that caused the grip on the work piece to become loose, posing a safety issue to workers and people around the work piece or the clamping tools. Also, the engagement of the threaded shaft 6 with the nut 13 is not solid due to the pushing force is from the helical spring 14.

Present invention improved upon the current art release mechanism by putting a housing 50 on top of the cover plate 16. A protrusion 52 is made on top surface of the quick acting push button 12. A cylindrical plunger 51 is inserted horizontally to a hole on one side of the housing 50. A horizontal helical spring 53 sits inside the hollowed portion of the plunger 51 and is compressed by plunger 51 against the other side of housing 50 for its intended operation.

Figure 3:
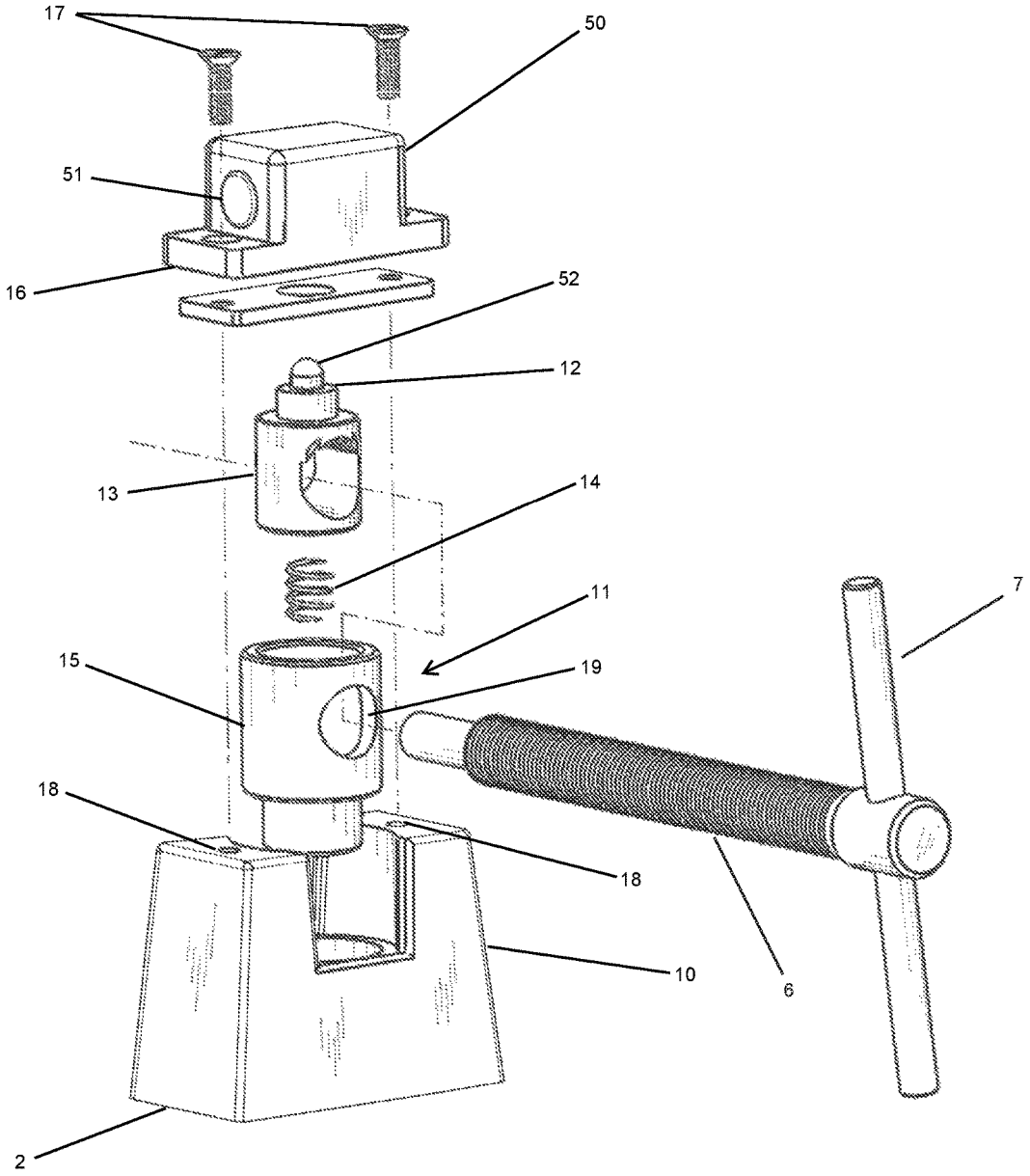
FIG. 3 shows the perspective view of the improved release mechanism, having the housing on top.

The housing 50 shown in present disclosure is in the shape of a rectangular box, as shown in FIG. 3. However, the housing 50 can take on other shapes, as long as it accommodates the plunger 51 and the operation as intended and explained herein.

Figure 6:
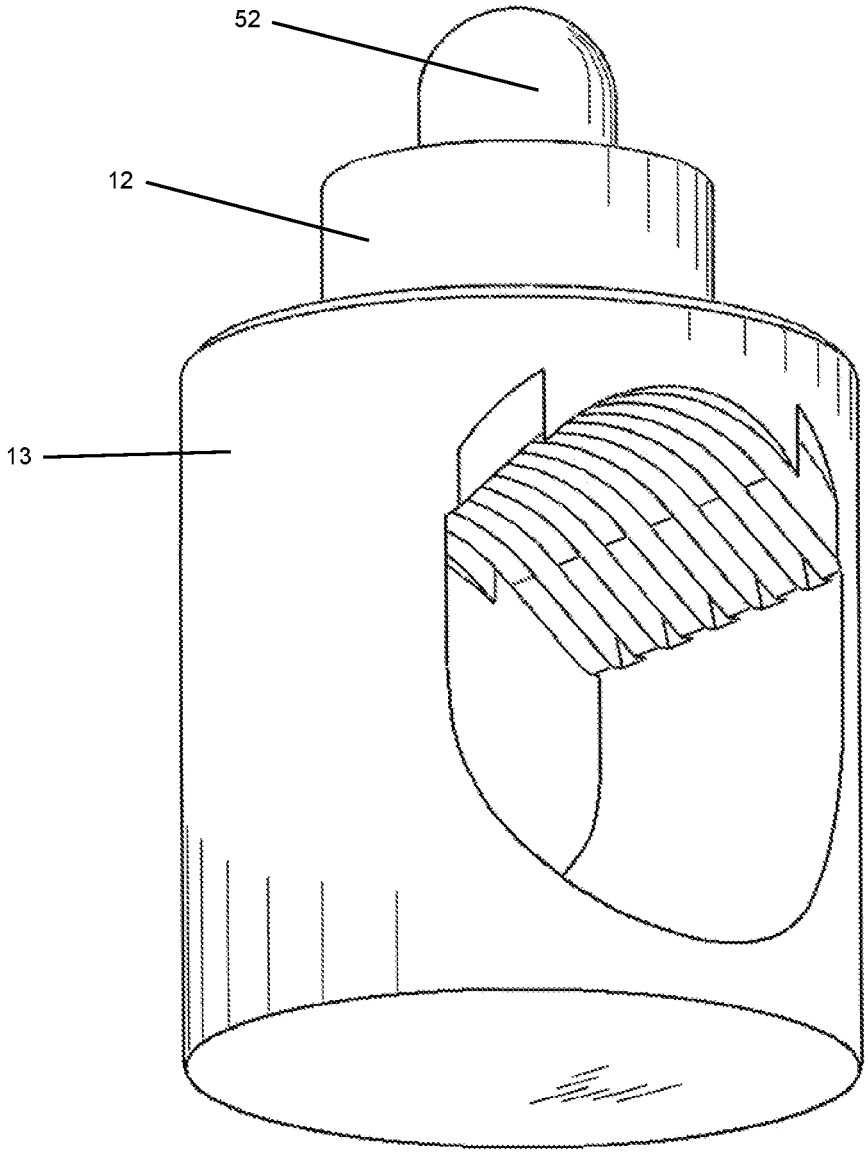
FIG. 6 shows the thread pattern on the upper half of the nut viewed from a bottom-up angle.
Figure 7:
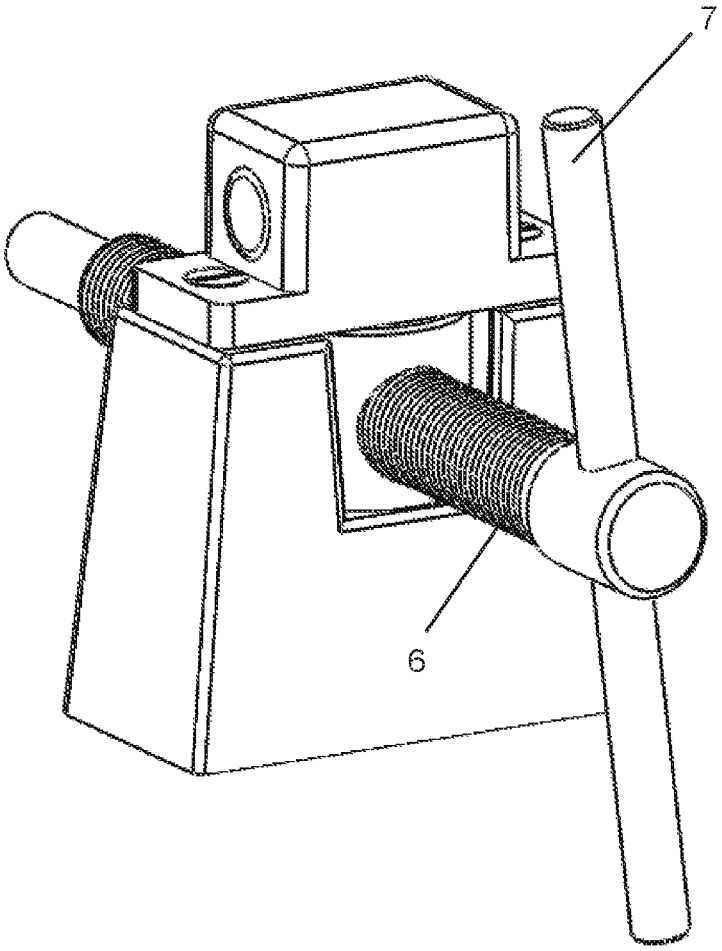
FIG. 7 shows the assembled view of the present invention, with the plunger in the pushed in position.

The design of the half-threaded nut 13 is modified so that screw threads are made to be on the upper inside half of the nut instead of the lower half, as shown in FIG. 6.

The middle of plunger 51 is made to have a section of smaller diameter where one side is cut vertically down to the smaller diameter section and the other side is cut at an angle so that the surface around the longitudinal axle of the plunger 51 takes on a conical shape.

Figure 4:
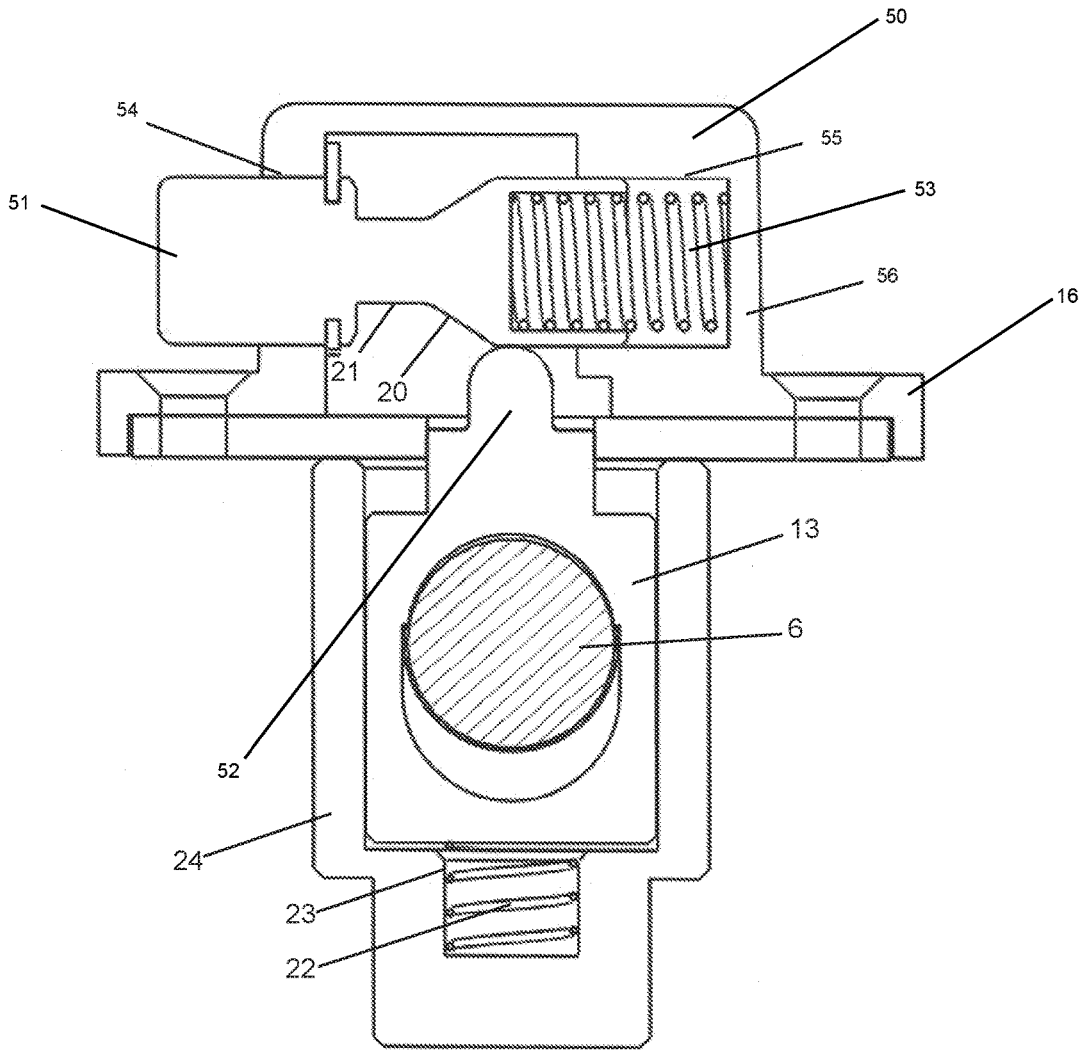
FIG. 4 is a cross-sectional view of the improved release mechanism of the present application where the plunger is in the normal position, and the nut is engaged to the threaded shaft.

FIG. 4 shows the plunger 51 at normal operating position. The plunger 51 is pushed out by horizontal helical spring 53, where protrusion 52 is forced downward by the conical surface of plunger 51, resulting in the half-threaded nut 13 to be pushed downward so that the screw threads on the upper half of the hole are engaged with the threaded shaft 6.

Since the nut 13 is pushed against the threaded shaft 6 by cam action on account of the shape of the plunger 51, the force is more solid than the resilient force of a helical spring 14 used in the current art structure, such as that of the 475 Patent. Also, even if the screw threads are worn out after long-term usage, thread slipping is less likely to happen by the design of present application.

Figure 5:
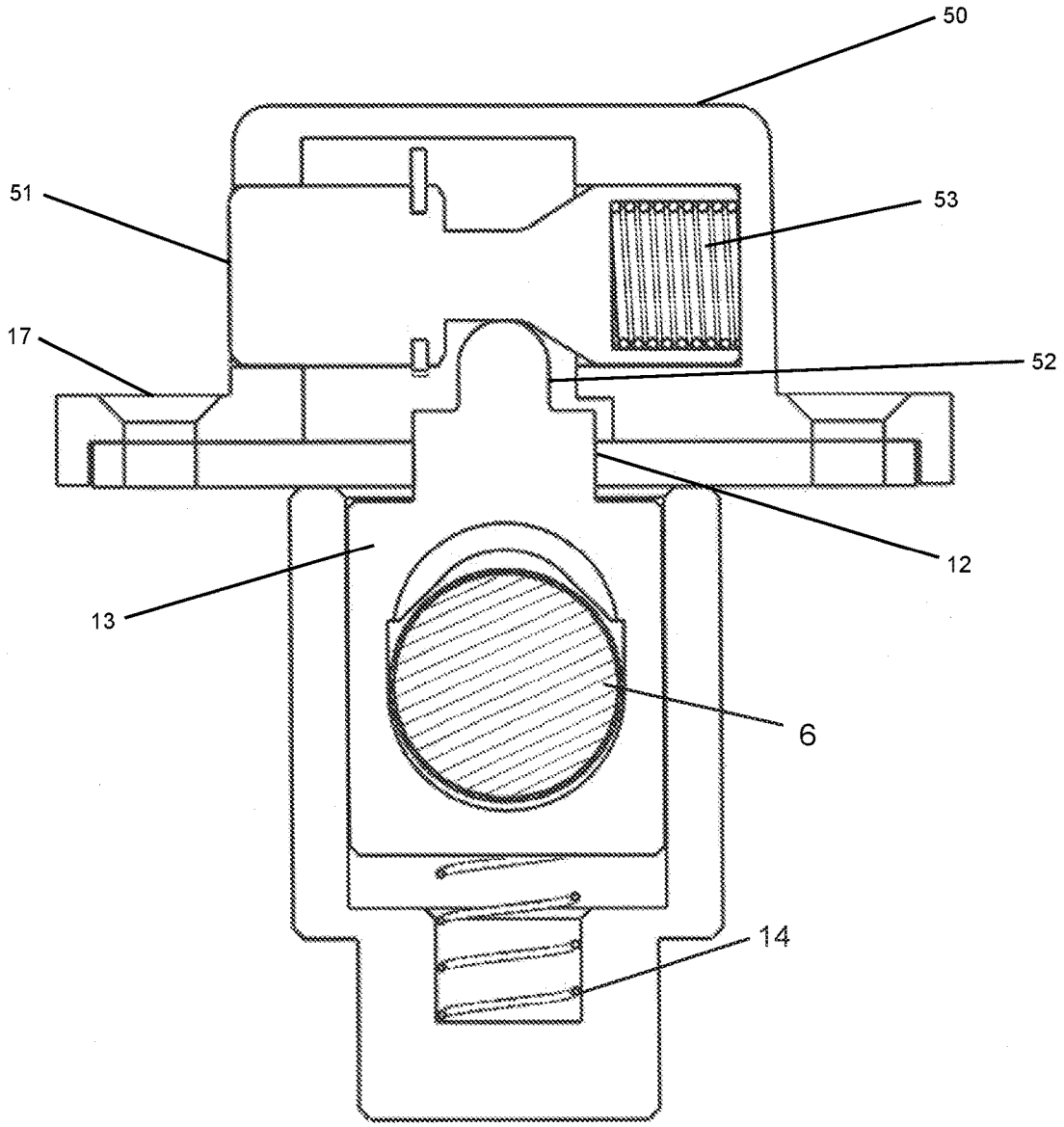
FIG. 5 is a cross-sectional view of the improved release mechanism of the present application where the plunger is in the pushed in position, and the nut is disengaged to the threaded shaft.

To release the engagement of nut 13 and threaded shaft 6, the plunger 51 is pushed inward to compress the horizontal helical spring 53, as shown in FIG. 5. The resilient power of the helical spring 14 will push nut 13 up and to wedge into the smaller diameter middle section of plunger 51. As such, the screw threads on the upper half of the threaded hole of nut 13 are disengaged from the threaded shaft 6 and the threaded shaft 6 is free to move forward or backward through nut 13, without the pitch-by-pitch turning of the shaft 6 and handle 7.

FIG. 6 provides a view for the half-threaded nut 13 where the thread lines are made on the upper portion of the nut 13.

The middle of the plunger is made to have a section of small diameter allowing the protrusion to be pushed downward in a normal position and allowing the protrusion to rely on the resilient power of the helical spring to push it upward into the small diameter section. When the plunger is pushed inward to compress the horizontal helical spring, this disengages the threaded shaft without any pitch by pitch turning of the shaft.

The cylindrical plunger 51 preferably has a housing 50 for retaining the cylindrical plunger 51. The cylindrical plunger 51 has a horizontal travel and passes through a plunger opening 54 so that it resides within and slides along a horizontal plunger guide 55. The horizontal plunger guide 55 is formed on the plunger retaining frame 56. The housing 50 has a plunger retaining frame 56. The plunger retaining frame can be formed of a solid piece of aluminum such as billet aluminum.

The horizontal plunger guide 55 also retains the horizontal helical spring 53. The horizontal plunger guide 55 can be formed as a hollow portion of the plunger retaining frame 56. The horizontal plunger abuts the sidewalls of the horizontal plunger guide 55 to allow translational motion. The plunger opening 54 can be cut by drilling or milling the plunger retaining frame 56.

The cylindrical plunger 51 having neck 21 of reduced diameter. A cam 20 is formed as a conical surface extending from the neck 21 of the cylindrical plunger 51. The cam 20 biases a protrusion 52 of the half threaded nut 13 to provide a vertical motion to the half threaded nut 13. The half threaded nut 13 is held within a half threaded nut retainer 24 to allow vertical motion of the half threaded nut 13. The half threaded nut retainer 24 is preferably formed as a guide to allow only vertical motion. The half threaded nut 13 is biased into an upward position by a vertical spring 22. The vertical spring 22 is mounted below the half threaded nut 13 to push the half threaded nut 13 upward. The vertical spring 22 is mounted within the vertical spring retainer 23. The vertical spring retainer is formed as a hollow portion of the half threaded nut retainer 24. The half threaded nut retainer 24 is preferably rigidly connected to the plunger retaining frame 56.

When the cylindrical plunger 51 is depressed, the cam 20 translates horizontally and is biased against the horizontal helical spring 53. The cam 20 allows upward motion of the protrusion 52. The protrusion 52 is preferably a rounded protrusion having a semi-circular profile. The vertical spring 22 is preferably a helical spring and the vertical spring 22 is preferably mounted within the vertical spring retainer 23 such that the vertical spring retainer 23 is formed as a cylindrical hollow shape to receiving the vertical spring 22. The housing preferably has a rectangular shape.

The invention claimed is:

1. An improved release mechanism for clamping tools, comprising:

a cover plate with a housing on the top surface of the cover plate;

a cylindrical plunger placed inside the housing;

a horizontal helical spring placed inside a hollowed portion of the plunger;

a threaded shaft for engaging with a half-threaded nut having a hole; and a protrusion extending from a push button on a top portion of the half-threaded nut, threads formed on an upper portion of the hole for engaging the threaded shaft, wherein the middle portion of the plunger is made to have a section of small diameter allowing the protrusion to be pushed downward in a normal position and allowing the protrusion to rely on the resilient power of the helical spring to push the protrusion upward into the small diameter section, when the plunger is pushed inward to compress the horizontal helical spring, disengaging the threaded shaft, without the pitch-by-pitch turning of the shaft.

2. The improved release mechanism of claim 1, wherein the housing has a rectangular shape.

3. The improved release mechanism of claim 1, wherein the small diameter portion of the plunger in the middle is shaped by cutting one side of the plunger vertically and cutting the other side at an angle to form a conical surface.

4. The improved release mechanism of claim 1, wherein the cover plate is fastened to an ear piece by screws.

5. The improved release mechanism of claim 1, wherein the housing forms a horizontal plunger guide that also retains the horizontal helical spring, wherein the horizontal plunger guide is formed as a hollow portion of a plunger retaining frame, wherein the horizontal plunger abuts sidewalls of the horizontal plunger guide to allow translational motion.

6. The improved release mechanism of claim 5, wherein the plunger has a neck of reduced cross-section, wherein a cam extends from the neck, wherein the cam biases a protrusion of the half threaded nut to provide a vertical motion to the half threaded nut, wherein the half threaded nut is held within a half threaded nut retainer to allow vertical motion of the half threaded nut, wherein the half threaded nut retainer is formed as a guide to allow vertical motion, wherein the half threaded nut is biased into an upward position by a vertical spring, wherein when the cylindrical plunger is depressed, the cam translates horizontally and is biased against the horizontal helical spring.

7. The improved release mechanism of claim 6, wherein the cam allows upward motion of the protrusion, wherein the vertical spring is a helical spring and the vertical spring are mounted within the vertical spring retainer such that the vertical spring retainer is formed as a cylindrical hollow shape to receive the vertical spring.

* * * * *